US006408585B1

(12) United States Patent
Tajima

(10) Patent No.: US 6,408,585 B1
(45) Date of Patent: Jun. 25, 2002

(54) ATTACHMENT STRUCTURE FOR UNDEFINED OR RANDOM-SHAPED WALL FACING MATERIAL

(76) Inventor: Hiroshi Tajima, 1-20-3, Minamikoyacho, Hitachi-Shi, Ibaraki (JP), 319-1224

( * ) Notice: Subject to any disclaimer, the term of this patent is extended or adjusted under 35 U.S.C. 154(b) by 0 days.

(21) Appl. No.: 09/546,230

(22) Filed: Apr. 10, 2000

(30) Foreign Application Priority Data

Apr. 19, 1999 (JP) ..... 11-111435

(51) Int. Cl.[7] ..... E04B 2/00; E04B 5/00; E04B 9/00

(52) U.S. Cl. ..... 52/506.06; 52/506.08; 52/385; 52/389

(58) Field of Search ..... 52/506.06, 506.08, 52/384, 385, 386, 387, 389, 315, 314, 404, 311.1

(56) References Cited

U.S. PATENT DOCUMENTS 4,238,915 A * 12/1980 Yoshida et al. ..... 52/510
4,803,821 A * 2/1989 Funaki ..... 52/387
4,856,245 A * 8/1989 Osawa ..... 52/386
4,856,246 A * 8/1989 Shimasaki ..... 52/386
4,916,875 A * 4/1990 Kashiwagi ..... 52/302
4,920,716 A * 5/1990 Coffey ..... 52/386
4,987,712 A * 1/1991 Mancuso ..... 52/387
5,398,473 A * 3/1995 Chan ..... 52/506.06
6,098,363 A * 8/2000 Yaguchi ..... 52/385
6,098,364 A * 8/2000 Liu ..... 52/506.08
6,202,377 B1 * 3/2001 Krieger ..... 52/489.1

FOREIGN PATENT DOCUMENTS

JP 2826043 9/1988
JP 7-35003 8/1995
JP 2535377 2/1997

* cited by examiner

*Primary Examiner*—Carl D. Friedman
*Assistant Examiner*—Kevin McDermott
(74) *Attorney, Agent, or Firm*—Wenderoth, Lind & Ponack, L.L.P.

(57) ABSTRACT

Random-shaped tiles are joined in an arbitrary array onto a front plane of a metal plate having holes, the metal plate being fixed to a backing plate. The random-shaped tiles are supported by supporting pieces of attaching pieces attached to the metal plate. The weight of the random-shaped tiles is received at the lower edge portion thereof by the supporting pieces, and the movement thereof in the direction of peeling away (forwards) is restricted at the upper edge portion of the random-shaped tiles by the supporting pieces. The random-shaped tiles can be joined to the metal plate having holes in a free array, and work can proceed speedily without any sagging during the joining work. Following joining, the random-shaped tiles are shielded from a good deal of vibrations and movement applied to the building frame, while being held in a secure joining state to the metal plate having holes.

17 Claims, 8 Drawing Sheets

ATTACHMENT STRUCTURE FOR UNDEFINED OR RANDOM-SHAPED WALL FACING MATERIAL

BACKGROUND OF THE INVENTION

1. Field of the Invention

The present invention relates to an attachment structure appropriate for attaching blocks or plates of tile, stone, etc., for wall facing that have not been formed in a uniform predetermined form, i.e., for attaching undefined or random-shaped wall facing material to reinforced concrete, wood, or other like, walls of buildings, and particularly to exterior walls.

2. Description of the Related Art

Conventionally, the wet method for attaching wall facing material such as tile or stone to the exterior wall of a building, wherein backing is fixed to posts or studs in the case of a wood building, for example, or wherein mortar backing is applied to the wall in the case of a reinforced concrete building, and an adhesive agent or mortar is applied to the backing so as to join the facing material thereto, has generally been used.

In comparison, the technique of the so-called dry method has been proposed and is being practiced, wherein linear metal pieces having hooking means are fixed to the above backing, and wall facing material configured with retaining means corresponding to the hooking means provided on the rear side thereof is attached thereto, thereby attaching wall facing material onto the backing in a speedy and accurate manner by retaining the retaining means of the latter on the hooking means of the former.

With the above wet method, the wall facing material such as tile is applied by adhesion to the backing from the bottom and working upwards, and particularly in the event of large and heavy wall facing material, there has been the problem in that the wall facing material to be installed above cannot be applied until the adhesive agent or mortar supporting the lower wall facing material already installed has hardened.

With the wet method technique, holding the weight of the applied wall facing material depends solely on the adhesive strength of the adhesive agent, so there is the problem of sagging wherein the wall facing material gradually descends by its own weight, which may mean that the position of the wall facing material needs to be corrected several times following attaching, or the work needs to wait until the adhesive agent or mortar supporting the lower wall facing material already installed hardens before applying the wall facing material to be installed above.

Further, due to such sagging, and an absence of an appropriate guide member for accurately arraying the wall facing material, there is the problem that accurate arraying of the wall facing material is difficult. In addition, there are no joining means between the wall facing material and the backing other than the adhesive agent or mortar, so there is the problem of peeling and falling of the applied tiles and the like due to deterioration over time of the adhesive agent or mortar, and swaying such as earthquakes, which cause weakening of the joints.

The dry method technique has been proposed and is being practiced as a method for solving the above problems in the wet method technique, and has the advantages that unskilled workers can speedily apply the wall facing material in an accurate array, there is no problem of sagging during work, and there is no problem of the wall facing material peeling away and falling due to motion such as earthquakes or deterioration of the adhesive agent and the like.

However, the above dry method technique is applicable to wall facing material of certain shapes such as specification items, and is not applicable to wall facing material of undefined or random shapes.

SUMMARY OF THE INVENTION

Accordingly, it is an object of the present invention to provide an attachment structure for undefined or random-shaped wall facing material, wherein attaching work can be continued without waiting for the adhesive agent or the like of the lower wall facing material already installed to harden before attaching the wall facing material to be installed above even in cases wherein undefined or random-shaped wall facing material is being sequentially applied on backing from the bottom toward the top, thereby improving work efficiency.

It is another object of the present invention to provide an attachment structure for undefined or random-shaped wall facing material, wherein a wall facing material attaching structure can be obtained which does not easily fall even in the event of being subjected to effects of movement of the backing such as vibrations like earthquakes or shrinking or deformation of the structure, or other like external forces, particularly in the event of attaching the wall facing material to the wall plane of a wood or steel framed building.

It is another object of the present invention to provide an attachment structure for undefined or random-shaped wall facing material, wherein a wall facing material attaching structure can be obtained which does not easily fall even in the event of deterioration of the adhesive agent or the like.

To this end, the attachment structure for random-shaped wall facing material according to the present invention involves a retaining plate provided with a great number of retaining members over then entire surface thereof being attached to the front plane of backing, multiple random-shaped wall facing material pieces being arrayed on the front plane of the retaining plate in an arbitrary layout, the random-shaped wall facing material pieces being adhered to the retaining plate and the backing at the rear plate thereof by spots of adhesive agent, and at least the upper portion and lower portion edges of the random-shaped wall facing material pieces being supported by multiple attachment pieces retained by retaining portions of the retaining plate, and further the space between adjacent random-shaped wall facing material pieces being filled with a jointing material.

The term "random-shaped wall facing material" means tile, stone, blocks, etc., that are to be adhered to the wall plane of a building and do not have a certain form, and includes all such non-orderly material which is used to create a varied design on the wall surface. While the random-shaped wall facing material with the above configuration may be used as is without problem, it is further preferable to strengthen the attachment state by fixing one end of a wire material to the rear plane thereof and the other end to the retaining portion of the retaining plate at the time of attaching the random-shaped wall facing material to the front plane of the retaining plate, thereby making the attachment of the retaining plate even more secure.

A commonly-used backing is used. For example, a backing plate is prepared, and this is attached to the frame structure of the building such as posts or the like, or in the event that the surface state of a reinforced concrete structure or the like is good and can be used, the surface of the frame structure is used as is as the backing.

There is the need for retaining portions to exist uniformly over the entire surface of the retaining plate, as described above. That is, the retaining plate is for arraying the random-shaped wall facing material on the front plane thereof and supporting at least the upper and lower edge portions of the random-shaped wall facing material with attaching pieces retained on the retaining portions of the retaining plate so as to be fixed at the position thereof, wherein the random-shaped wall facing material is indeed undefined in form, so the attaching pieces may be attached to various retaining positions on the retaining plate depending on the form of the random-shaped wall facing material piece. Thus, the retaining portions of the retaining plate must be provided over the entire surface thereof as a matter of course, so that any retaining position of the attachment pieces which can come at various positions can be dealt with.

Accordingly, as a specific arrangement, a preferable attachment structure uses either one or the other of the following as the retaining plate: a metal plate having a great number of retaining holes serving as the retaining portions opened over the entire surface thereof in a uniform manner; or a net-shaped metal material having retaining mesh of an appropriate coarseness to serve as the retaining portions.

Also, the retaining plate and backing may be joined with a free configuration, but it is preferable to join the retaining plate and the backing with somewhat of a gap therebetween. A joint of such a configuration allows space between the random-shaped wall facing material joined at the front plane of the retaining plate and the backing fixed to the frame structure, so that any warping of the building itself or shocks which the building receives are not directly transmitted to the random-shaped wall facing material, thereby keeping problems of cracking, peeling, etc., thereof from occurring easily.

Accordingly, it is appropriate for the joining portion of the retaining plate for joining with the backing to be configured of a trapezoidal portion protruding on the thickness direction and a screw hole opened in the center thereof, wherein the retaining plate is brought into contact with the backing by the trapezoidal protrusion, and fixed with a screw screwed into the backing through the screw hole.

Also, the attaching piece is not restricted to a specific arrangement so long as the attaching piece can be attached to the retaining portions provided to the entire surface of the retaining plate, and is capable of supporting the edge portion of the random-shaped wall facing material arrayed at the front plane of the retaining plate.

Regarding the method of supporting thereby, a configuration may be used wherein, of the attaching pieces, the attaching pieces which support the lower edge portion of the random-shaped wall facing material support the random-shaped wall facing material by the lower edge thereof being placed thereupon. Regarding the attaching pieces supporting the upper edge of the random-shaped wall facing material, there is the need for a configuration wherein the upper edge portion is in a generally nipped state by the attaching pieces in cooperation with the retaining plate at the rear side thereof.

For example, an attachment piece of the type wherein the lower edge portion of the random-shaped wall facing material is placed thereupon as with the former can be configured by comprising a retaining piece being retained by the retaining portion of the retaining plate, and a receiving-plate-shaped supporting piece continuing therefrom upon which is placed the lower edge portion of the random-shaped wall facing material placed on the front plate of the retaining plate. Also, an attachment piece of the type wherein the upper edge portion of the random-shaped wall material is in a generally nipped state with the retaining plate as with the latter can be configured by comprising a retaining piece for being retained by the retaining portion of the retaining plate and a supporting piece continuing therefrom for supporting the upper edge portion of the random-shaped wall facing material placed on the front plate of the retaining plate in a generally nipped state, by cooperating with a corresponding portion of the retaining plate.

Also, an adhesive agent having elasticity is preferably used in order to deal with swaying due to earthquakes and deformation and the like of the building structure. Of course, an appropriate type may be selected from conventional adhesive agents.

Further, commercially-available jointing material used for the above purpose is sufficient for the jointing material.

Accordingly, with the attachment structure for random-shaped wall facing material according to the present invention, in the event that the object building is of wood or steel frame structure or the like, the backing is attached to the structure such as to posts and the like, and in the event that the structure is reinforced concrete, the surface of the structure is used as is or backing is used by applying mortar or the like thereto to smooth the surface, following by attaching the retaining plate to the front plane thereof. This retaining plate has a great many retaining portions configured over the entire surface thereof, as described above.

Next, the random-shaped wall facing material has an adhesive agent applied to the rear side thereof and is joined to the front plane of the retaining plate at an arbitrary position, with at least the lower edge portion and upper edge portion thereof being supported at the same time or immediately after. Also, in the event that further strengthening of the attachment state of the random-shaped wall facing material is desired, it is preferable that one end of a wire member be fixed to the rear plane of the random-shaped wall facing material as described above, and at the time of joining the rear side with adhesive agent applied thereto at an arbitrary position on the retaining plate as described above, the other end of the wire member be tied to an appropriate retaining portion on the retaining plate. Further, at the time of positioning the random-shaped wall facing material, attaching the attaching piece to a retaining portion at an appropriate corresponding position on the retaining plate beforehand according to the position of attachment facilitates ease of installation. As described above, a great number of retaining portions are provided over the entire surface of the retaining plate, so the attaching piece can be attached to approximately the arbitrary desired position. Thus, the attaching pieces can be retained at appropriate positions to easily deal with random joining of the random-shaped wall facing material pieces, as well.

Thus, the random-shaped wall facing material pieces are held at arbitrary positions on the retaining plate by the attaching pieces, with the weight thereof being received by the attaching pieces provided at the bottom edge in particular, so force in the direction of peeling away is restricted by the upper attaching pieces and lower attaching pieces. As a result, problems such as sagging of the random-shaped wall facing material do not occur even in the event that the adhesive agent has not sufficiently hardened. Thus, there is no need for correcting the array position, and random-shaped wall facing material pieces can sequentially be attached upwards from the bottom without waiting for the adhesive agent applied between the random-shaped wall facing material and retaining plate and the backing to harden. Fixing one end of a wire material to the rear plane of the random-shaped wall facing material and tying the other end to a retaining portion of the retaining plate as described above makes the attachment of the random-shaped wall facing material to the retaining plate even more secure from the beginning, so the above advantages can be had in an even more sure manner.

It should be noted that, though the above description mentions the random-shaped wall facing material being attached from the bottom upwards, the present invention is not restricted to such. Rather, installation may be performed from the side or from the top, without any problem.

After joining the random-shaped wall facing material to the wall face area as described above, the gaps between the adjacent random-shaped wall facing material pieces are filled in with a jointing material. Thus, the edge portions of the attaching pieces are imbedded in the jointing material, and no longer are visible.

Thus, according to the attachment structure for random-shaped wall facing material according to the present invention, the weight of each wall facing material piece is received by the attaching pieces and the wire members provided as necessary, so force in that direction is not applied to the adhesive agent. That is to say, hardly any force other than that orthogonal to the adhesive plane of the adhesive agent is applied. As a result, elastic adhesive agents which have weak shearing strengths can be used, and consequently, this can be used to absorb and alleviate movement, shock, vibration, etc., of the backing. Hence, cracking and falling of the random-shaped wall facing material can be prevented. The random-shaped wall facing material pieces are also supported by attaching pieces and wire members provided as necessary, so falling of the wall facing material pieces is clearly prevented by these as well.

BRIEF DESCRIPTIONS OF THE DRAWINGS

Figure 7A:
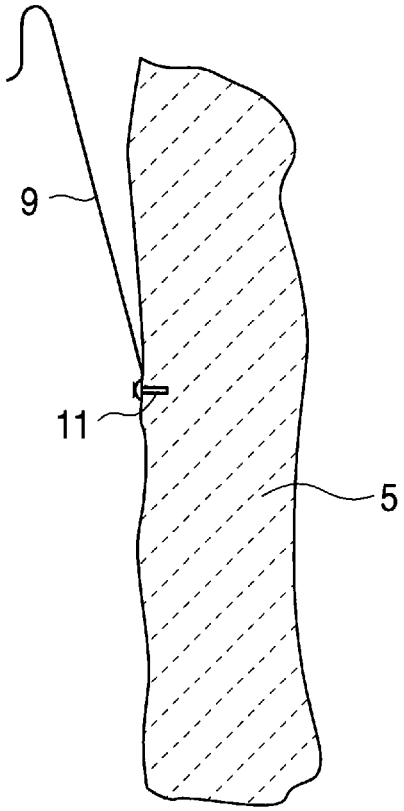
FIG. 7A is a cross-sectional explanatory diagram of the second embodiment, illustrating a state of a wire being fixed to the rear plane of a random-shaped tile.
Figure 7B:
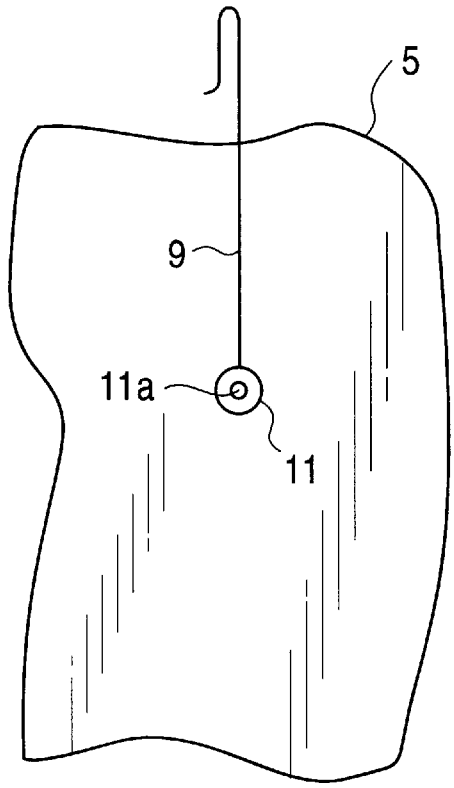
FIG. 7B is a rear view explanatory diagram of the second embodiment, illustrating a state of a wire being fixed to the rear plane of a random-shaped tile.
Figure 7C:
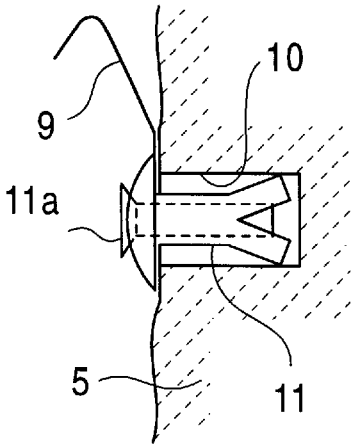
Figure 8:
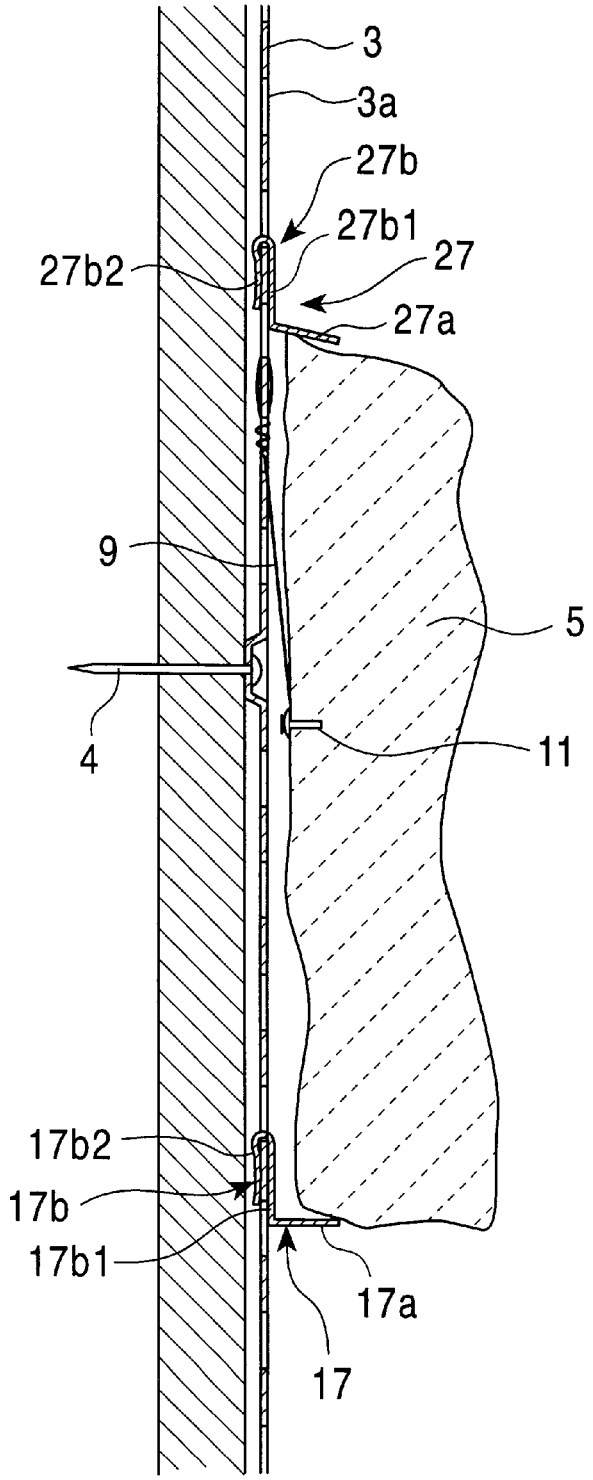

FIG. 7C is an enlarged cross-sectional partial view of the second embodiment, illustrating a state of a joining pin to which a wire is fixed being inserted and fixed in a joining hole bored in the rear plane of the random-shaped tile; and FIG. 8 is a schematic cross-sectional side view of the second embodiment in a state of the random-shaped tile attached to the metal plate with holes, in which an elastic adhesive agent and jointing material have been omitted in order show the wire better.

DESCRIPTION OF THE PREFERRED EMBODIMENTS

Two preferable embodiments of the present invention will be described in detail now with reference to the appended drawings.

First, a first embodiment wherein the present invention is applied to an exterior wall of a wooden building will be described with reference to FIGS. 1 through 4.

Figure 1:
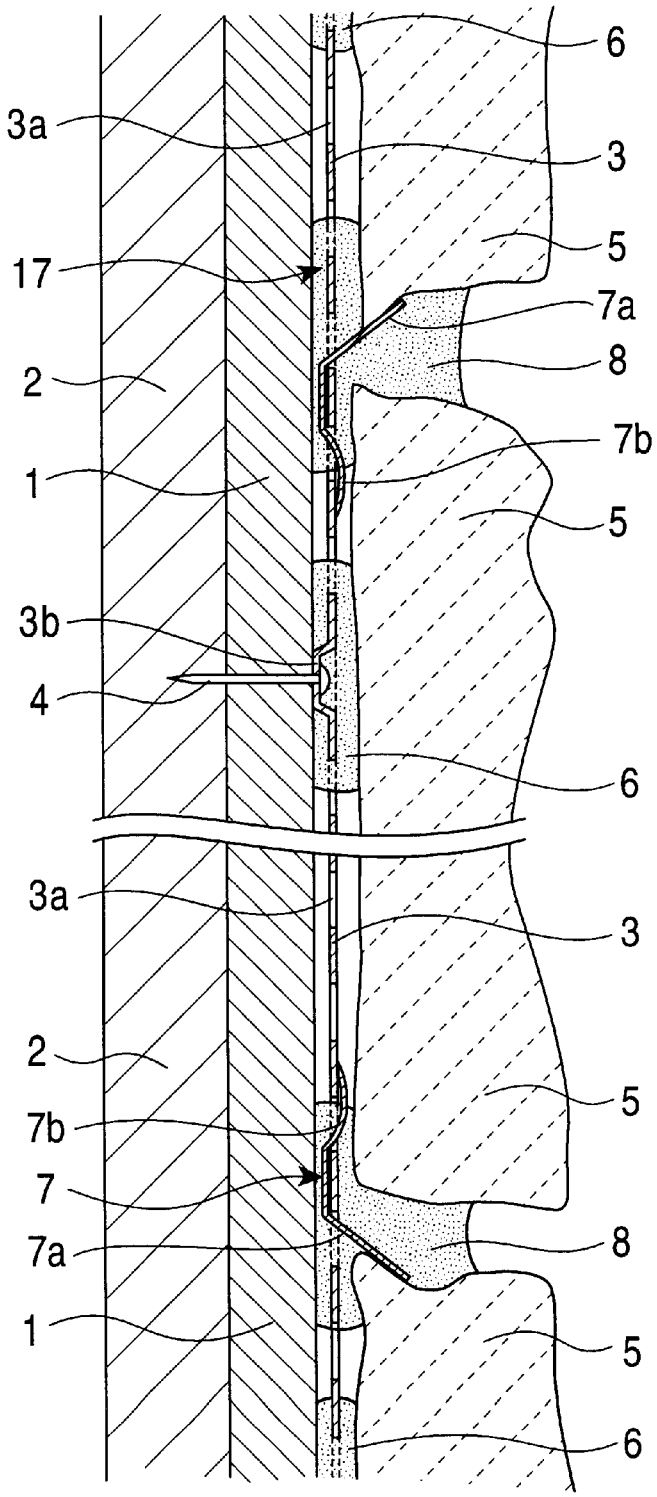
FIG. 1 is a schematic cross-sectional side view of a first embodiment.

As shown in FIG. 1, a backing plate 1 is provided around the frame. The backing plate 1 is fixed to frame posts 2 or studs by screws, nails, or the like.

Figure 3:
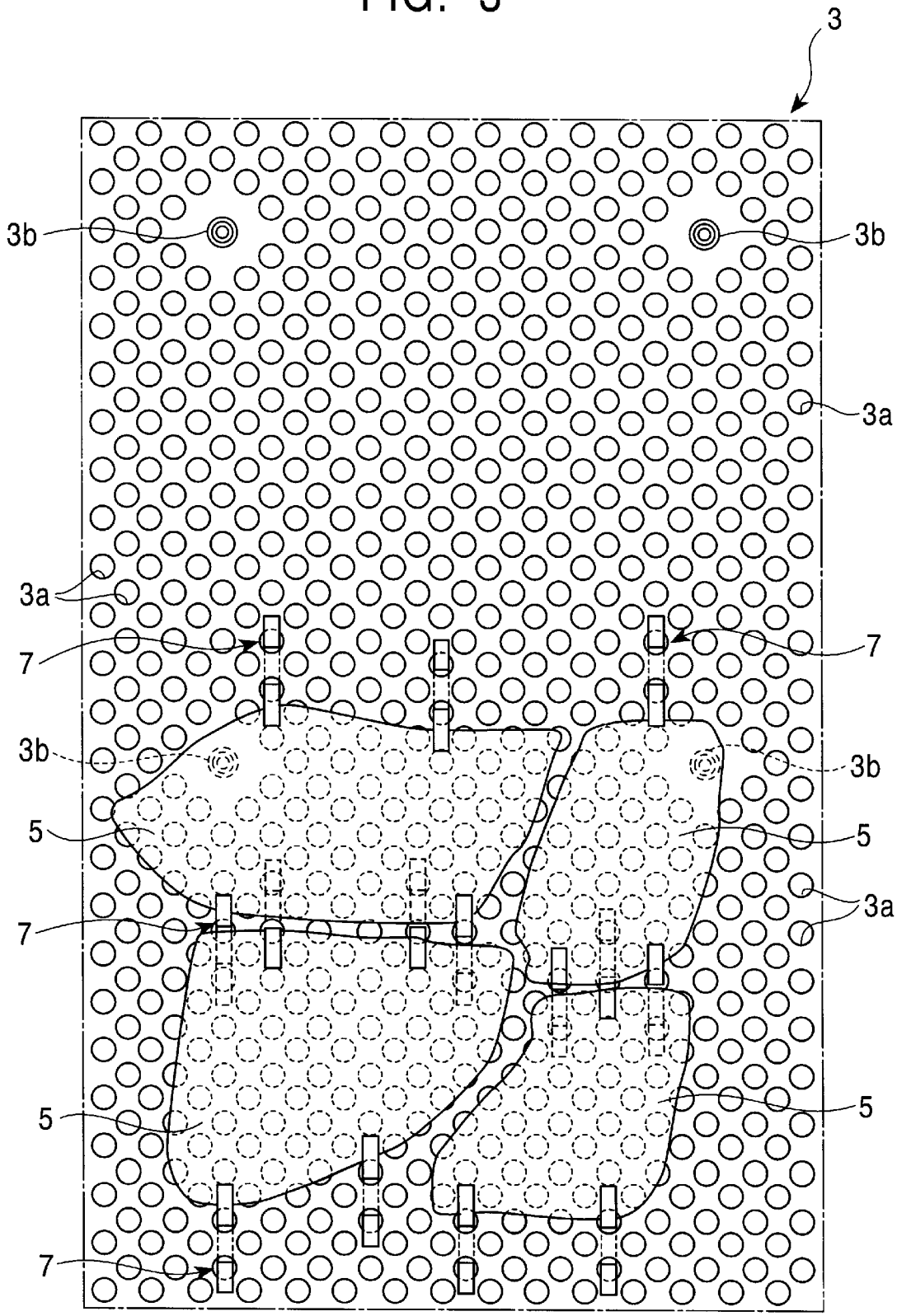
FIG. 3 is a schematic frontal explanatory diagram of the first embodiment, illustrating a state wherein random-shaped tiles are applied to a portion of the metal plate with holes attached to a backing plate.
Figure 4:
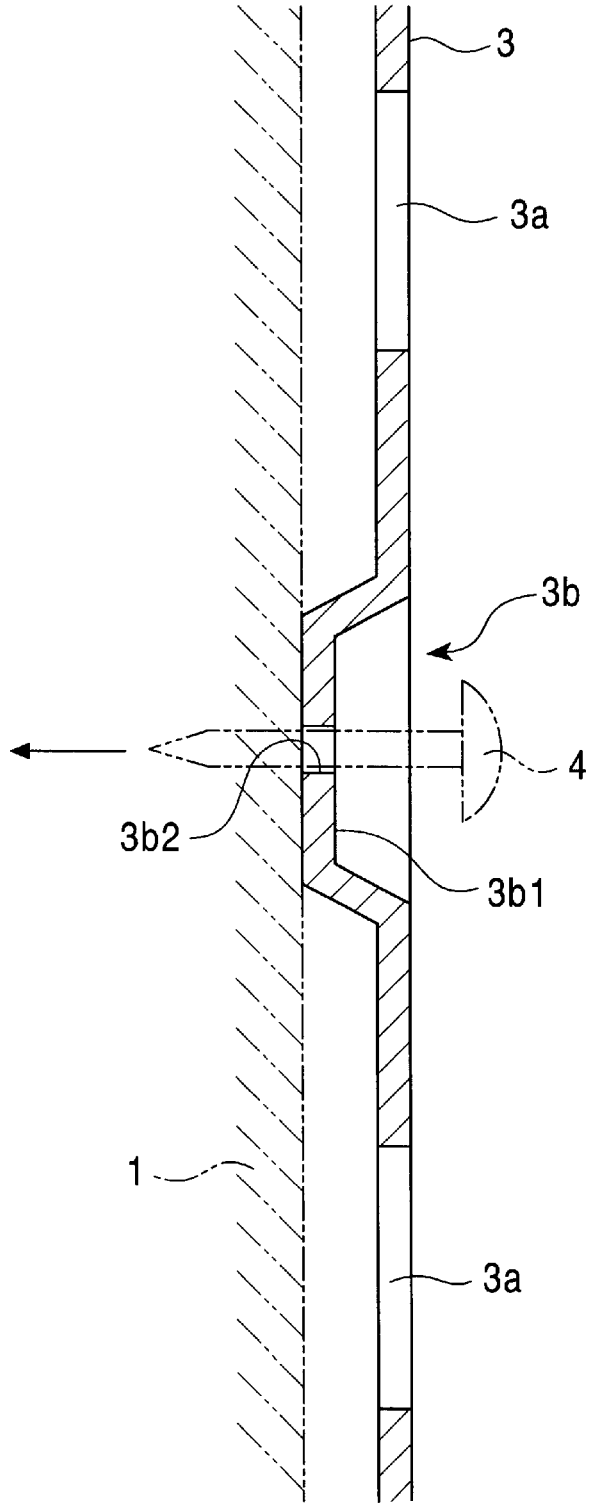
FIG. 4 is an enlarged cross-sectional diagram mainly of one joining portion of the metal plate with holes, according to the first embodiment.

A metal plate with holes (retaining plate) 3, formed by uniformly opening a great number of retaining holes (retaining portions) 3*a* over the entire surface thereof, is fixed to the front plane of the backing plate 1, as shown in FIG. 3. As shown in FIGS. 1 and 3, the metal plate with holes 3 has multiple joining portions 3*b* formed at predetermined intervals, and at each joining portion 3*b* is formed a trapezoidal protrusion 3*b*1 protruding in a trapezoidal form in one direction, and a screw hole 3*b*2 opened in the center thereof, as shown in FIG. 4. Accordingly, the metal plate with holes 3 is positioned so that the trapezoidal protrusions 3*b*1 of the joining portions 3*b* are facing the backing plate 1, with the other plane in contact with the front plane of the backing plate 1, upon which screws 4 are screwed through the screw holes 3*b*2 and through the backing plate 1 into the hind post 2, and the arrangement is fixed. As shown in FIG. 1, the front plane of this metal plate with holes 3 thus attached is separated from the front plane of the backing plate 1 by a gap which is the thickness of the metal plate with holes 3 plus the height of the trapezoidal protrusions 3*b*1.

As shown in FIGS. 1 and 3, random-shaped tiles 5 are joined to the front plane of the metal plate with holes 3. The above random-shaped tiles 5 which have arbitrary forms can be joined thereto in arbitrary arrays. At the time of joining, at least one spot of elastic adhesive agent 6 is applied to the rear plane of each random-shaped tile 5 and this is pressed against an arbitrary position on the metal plate with holes 3 so as to be joined thereto. Here, either beforehand or immediately after this, attaching pieces 7 are attached to the retaining holes 3*a* of the metal plate with holes 3 corresponding with the upper edge portion and lower edge portion of the random-shaped tile 5, so that each support the edge portions with supporting pieces 7*a*, as shown in FIG. 1 or FIG. 3. As described above, there are a great number of the retaining holes 3*a* formed over the entire surface of the metal plate with holes 3 in a uniform manner, so even in the event that the random-shaped tiles 5 of arbitrary form are joined thereto in an arbitrary array, the attaching pieces 7 can be provided to positions corresponding to the upper edge portion and lower edge portion thereof.

Figure 2:
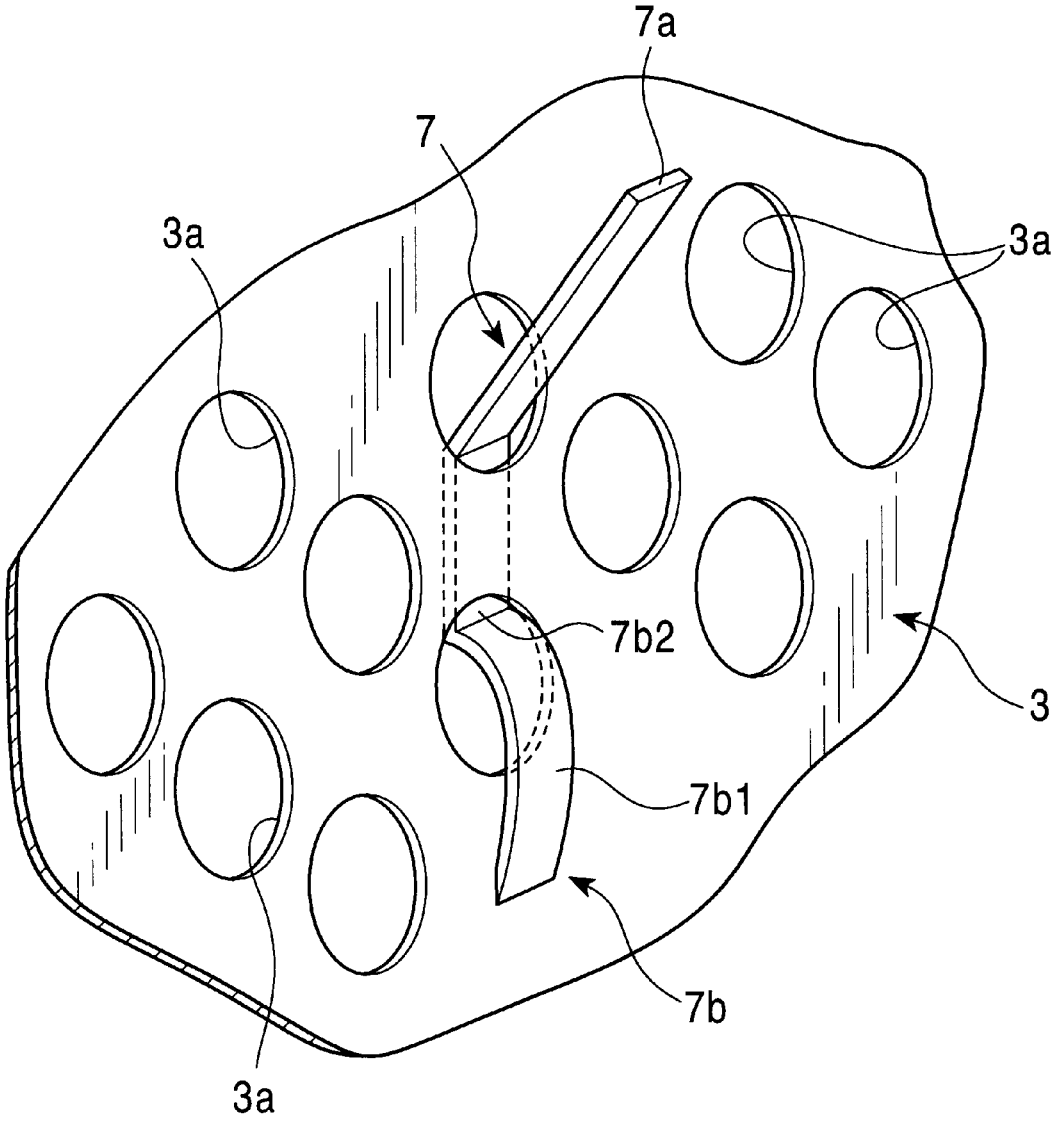
FIG. 2 is a perspective view illustrating a state of an attaching piece of the first embodiment being attached to a metal plate with holes.

As shown in FIGS. 1 and 2 in particular, the attaching pieces 7 are each formed of the supporting piece 7*a* and a retaining piece 7*b*. The retaining piece 7*b* is formed of a half-circle arc-shaped portion 7*b*1 at the outer edge side and a linear portion 7*b*2 continued therefrom at the inner edge side. At the time of attaching an attaching piece 7 to the metal plate with holes 3, the configuration is such that the inner plane thereof is arranged to face the metal plate with holes 3 and the backing 1. The supporting piece 7*a* is of a linear configuration extended from a slight outward bend from the outer edge portion of the linear portion 7*b*2 of the retaining piece 7*b*. The attaching piece 7 is formed of a metal plate having a certain degree of resilience, the length of the linear portion 7b2 of the retaining piece 7b is made to be a dimension slightly exceeding the length of the portion between adjacent retaining holes 3 a of the metal plate with holes 3, and the length of the half-circle arc portion 7b1 is made to be a dimension exceeding the diameter of the retaining hole 3a.

Accordingly, as shown in FIGS. 1 and 2, the attaching piece 7 is arranged such that the supporting piece 7a thereof protrudes from a retaining hole 3a of the metal plate with holes 3 in a manner corresponding to the edge portion of the object random-shaped tile 5. The linear portion 7b2 of the retaining piece 7b is arranged so as to be positioned at the rear plane side between the above retaining hole 3a and the adjacent retaining hole 3a (in the case of this example, the retaining bole 3a above or below). Further, the half-circle arc-shaped portion 7b1 of the retaining piece 7b is made to protrude from the neighboring retaining hole 3a with the tip portion thereof coming into contact with the front plane of the metal plate with holes 3.

Thus, the lower edge portion and upper edge portion of the random-shaped tiles 5 are supported by the supporting pieces 7a of the attaching pieces 7 protruding from the corresponding retaining holes 3a in the metal plate with holes 3, as shown in FIGS. 1 and 3. That is, each random-shaped tile 5 is held at the lower edge portion thereof by the supporting piece 7a protruding from a retaining hole 3 a and the corresponding portion of the metal plate with holes 3 in a somewhat nipped manner, with the weight thereof being received by the supporting piece 7a. Also, each random-shaped tile 5 is held at the upper edge portion thereof by the supporting piece 7a protruding from a corresponding retaining hole 3a of the metal plate with holes 3 and the corresponding portion of the metal plate with holes 3 in a somewhat nipped manner, with movement thereof in the direction of peeling away (forwards) being restricted by the supporting piece 7a.

Accordingly, the random-shaped tiles 5 are held at arbitrary positions on the metal plate with holes 3 by the attaching pieces 7 with the weight thereof being received, and the force in the direction of peeling away (forwards) being restricted. Therefore, there are no problems of sagging and the like of the random-shaped tiles 5 even in the stage where the elastic adhesive agent 6 is not sufficiently hardened. Accordingly, there is no need to perform correction and the like of the arrayed position at the time of adhesion, and the weight of the upper random-shaped tiles 5 are not placed on the lower random-shaped tiles 5, so the task of sequentially joining random-shaped tiles 5 upwards can proceed without problem.

Following joining the random-shaped tiles 5 to the entire wall area where the metal plate with holes 3 has been attached, a jointing material 8 is used to fill the gaps between the adjacent random-shaped tiles 5. This is performed using a conventional technique. Thus, the supporting pieces 7a at the outer edge portion of the attaching pieces 7 become imbedded in the jointing material 8 and are no longer visible.

Thus, according to the attachment structure for random-shaped wall facing material of this first embodiment, the weight of the random-shaped tiles 5 is received by the attaching pieces 7, so that the force in the weight direction of the random-shaped tiles 5 is not applied to the elastic adhesive agent 6. Thus, the attaching pieces 7 cover the weak point of the elastic adhesive agent 6 which is the shearing strength thereof, while obtaining the advantages of the elasticity of the elastic adhesive agent 6, i.e., absorbing and alleviating movement, shock, vibration, etc., of the backing, thereby preventing cracking and falling of the random-shaped tiles 5. Further, the random-shaped files 5 are also supported by the attaching pieces 7, and thus falling is also prevented by these, as a matter of course.

Incidentally, as described above, the arrangement is such that there is space between the front plane of the backing 1 and the rear plane of the random-shaped tiles 5 attached to the front plane of the metal plate with holes 3, due to the joining portions 3b between the metal plate with holes 3 and the backing 1 being formed of trapezoidal protrusions 3b1 protruding in a trapezoid form and screw holes 3b2 opened in the center thereof and the metal plate with holes 3 formed thus being attached to the backing 1, so that warping of the building itself or shock received by the building is not directly transferred to the random-shaped tiles 5, and problems such as cracking, peeling, etc., thereof do not occur easily.

Next, a second embodiment-applied to the exterior wall of a-wooden building as with the first embodiment will be described with reference to FIGS. 5 through 8.

The second embodiment differs from the first embodiment in that the attaching pieces 7 in the first embodiment have been replaced with attaching pieces 17 and 27, and wires (wire members) 9 are tied to the rear plane of the random-shaped tiles 5 and these wires 9 are used to strengthen the attachment to the metal plate with holes 3. Accordingly, the description will be centered around portions differing from the first embodiment, and the description regarding portions that are the same will be omitted on occasion. Members or portions in FIGS. 5 through 8 which are the same as those in the first embodiment will be denoted with the same reference numerals.

Figure 5:
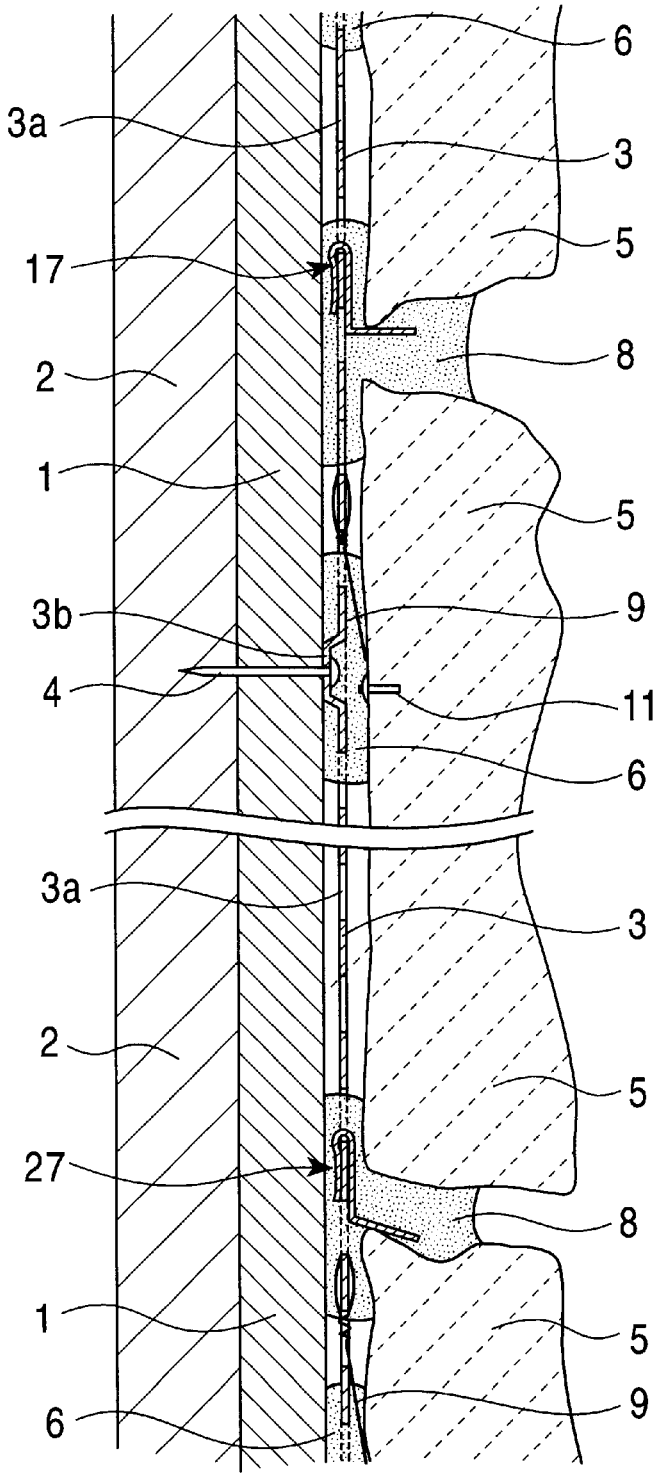
FIG. 5 is a schematic cross-sectional side view of a second embodiment.

As shown in FIG. 5, a backing plate 1 is fixed to frame posts 2 or studs, and a metal plate with holes 3 is fixed in front of the backing plate 1, as in the first embodiment. The metal plate with holes 3 is of a configuration exactly the same as that in the first embodiment, and is attached to the backing plate 1 in the same manner.

The random-shaped tiles 5 are joined to the front plane of the metal plate with holes 3. The random-shaped tiles 5 themselves are of exactly the same configuration as those in the first embodiment, but as described above, a wire 9 is tied to the rear plane of each as shown in FIG. 8, and thus the attachment to the metal plate with holes 3 is strengthened, as described later.

As shown in FIGS. 7A–B, one end of the wire 9 is tied to the rear plane of each random-shaped tile 5 at a position slightly above the center portion. As shown in FIG. 7C, a joining hole 10 is bored at a predetermined position on the rear plane of each random-shaped tile 5, and the base of a joining pin 11 to which the wire 9 is fixed is inserted into the joining hole 10. Subsequently, an internal pin 11a inserted partway into the joining pin 11 from the head side thereof is forcibly pressed in, thereby expanding the edge within the base portion. The edge within the base portion that has been thus expanded presses against the inner circumference of the joining hole 10, and thus the joining pin 11 is joined to the joining hole 10. The one end of the wire 9 is also thus tied into the rear face of the random-shaped tile 5.

The random-shaped tiles 5 are joined to the metal plate with holes 3 in the same manner as with the first embodiment, but at this time, the other end of the wire 9 tied to the rear plane of the random-shaped tile 5 is extended to the two adjacent retaining holes 3a on the metal plate with holes 3 above the joining portion, and passed therethrough and tied off, thereby hanging the random-shaped tiles 5 from the metal plate with holes 3 by the wires 9 for support.

Also, here, either beforehand or immediately after this, attaching pieces 17 and 27 are attached to the retaining holes 3*a* of the metal plate with holes 3 corresponding with the upper edge portion and lower edge portion of the random-shaped file 5, so that each support the edge portions with the supporting pieces 1 7*a* and 27*a*, as shown in FIG. 5 or FIG. 8. As described in the first embodiment, there are a great number of the retaining holes 3*a* formed over the entire surface of the metal plate with holes 3 in a uniform manner, so the attaching pieces 17 and 27 can be provided to practically any position.

Figure 6:
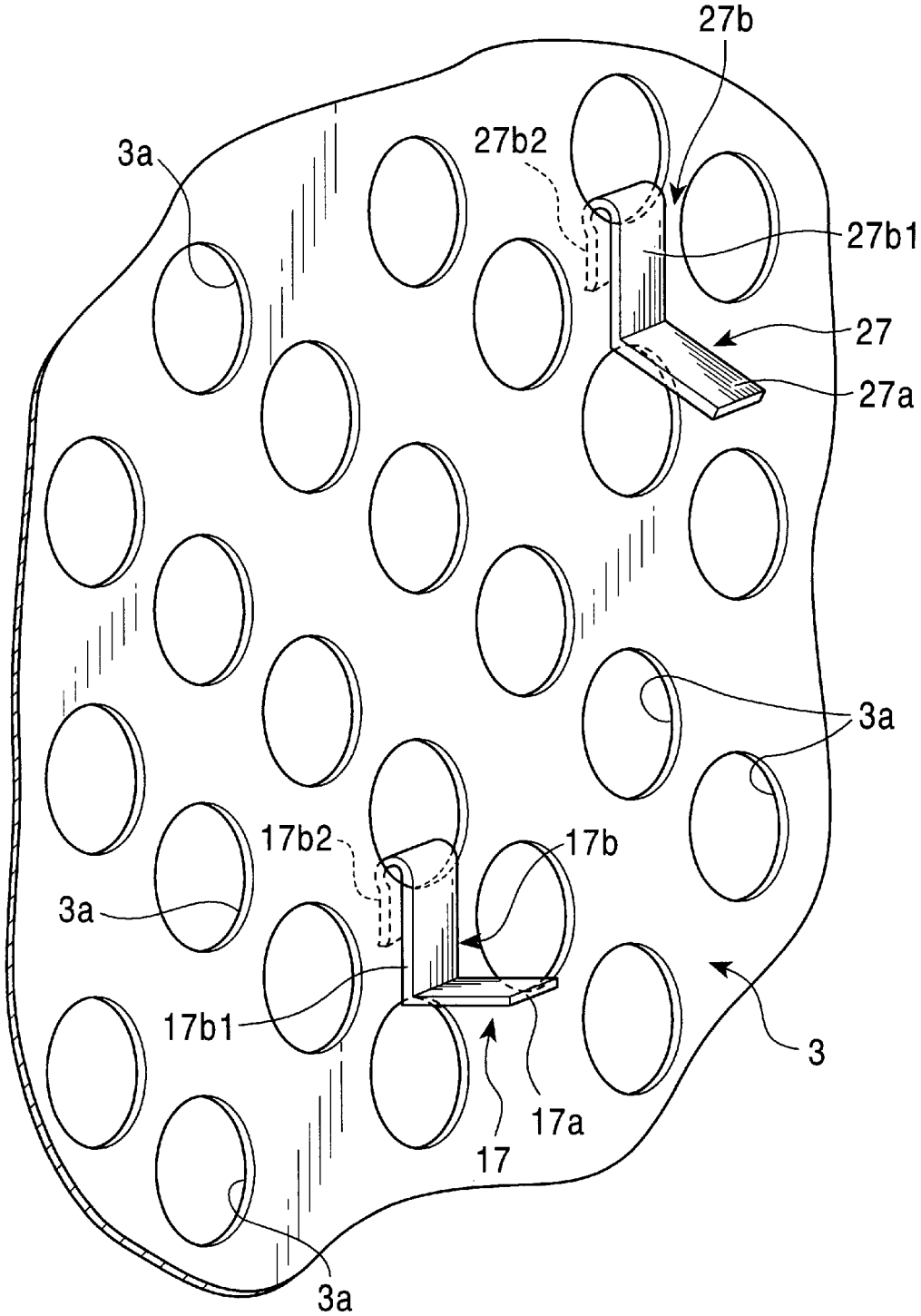
FIG. 6 is a perspective view of a state wherein two types of attaching pieces according to the second embodiment are attached to the metal place with holes.

As shown in FIG. 6 in particular, the attaching pieces 17 are each formed of a supporting piece 17*a* and a retaining piece 17*b*. The retaining piece 17*b* is formed of a perpendicularly-rising tab portion 17*b*1 and a nipping portion 17*b*2 folded back toward the rear from the top thereof. As shown in the Figure, the retaining piece 17*b* can be retained in a nipping matter at the edge portion of the retaining hole 3*a* of the metal plate with holes 3, by the tab portion 17*b*1 and nipping piece 17*b*2. The supporting piece 17*a* has a configuration of being extended forward from the lower edge of the tab portion 17*b*1 of the retaining piece 17*b* at almost a right angle. Accordingly, the supporting piece 17 can receive and support the lower edge of the random-shaped tile 5 thereupon.

On the other hand, as also shown in FIG. 6, the attaching pieces 27 are also each formed of a supporting piece 27*a* and a retaining piece 27*b*. The retaining piece 27*b* is exactly the same as that of the attaching piece 17, and is formed of a perpendicularly-rising tab portion 27*b*1 and a nipping portion 27*b*2 folded back toward the rear from the top thereof, and as shown in the Figure, the retaining piece 27*b* can be retained in a nipping manner at the edge portion of the retaining hole 3*a* of the metal plate with holes 3 by the tab portion 17*b*1 and nipping piece 17*b*2. The supporting piece 27*a* has a configuration of being extended forward from the lower edge of the tab portion 27*b*1 of the retaining piece 27*b* at a slightly downward inclination. Accordingly, the supporting piece 27*a* can restrict the upper edge of the random-shaped tile 5 from above so that it does not move away from the metal plate with holes 3.

Accordingly, as shown in FIGS. 5 and 8, the attaching pieces 17 are positioned on the metal plate with holes 3 such that the supporting piece 17*a* can receive the lower edge portion of the object random-shaped tile 5, and as described above. In addition, the retaining piece 17*b* is retained at the edge portion of the retaining hole 3*a* at the corresponding position. Also, as shown in FIGS. 5 and 8, the attaching pieces 27 are positioned on the metal plate with holes 3 such that the supporting piece 27*a* can restrict the upper edge portion of the object random-shaped tile 5 so as to not fall outwards, and as described above, the retaining piece 27*b* is retained at the edge portion of the retaining hole 3*a* at the corresponding position.

That is to say, each random-shaped tile 5 is supported by being placed on the supporting piece 17*a* of the attaching piece retained at the edge portion of the retaining hole 3*a* at the corresponding position on the metal plate with holes. 3, and the weight thereof is received by the supporting piece 17*a*. Also, at the upper edge, each random-shaped tile 5 is held in a somewhat nipped manner between the supporting piece 27*a* of the attaching piece 27 retained at the edge portion of the retaining hole 3*a* at the corresponding position on the metal plate with holes 3 and the corresponding position of the metal plate with holes 3, so that the movement in the direction of peeling away (forwards) is restricted by the supporting piece 27*a*.

Thus, each random-shaped tile 5 is held at its arbitrary position on the metal plate with holes 3 by the attaching pieces 17 and 27 and the wire 9, so that the weight thereof is received in a manner even more secure than that of the first embodiment, and the force thereof in the direction of peeling away (forwards) is restricted. Therefore, there are no problems of sagging and the like of the random-shaped tiles 5 even in the stage wherein the elastic adhesive agent 6 is not sufficiently hardened. Accordingly, there is no need to perform correction and the like of the arrayed position at the time of adhesion, and the weight of the upper random-shaped tiles 5 are not placed on the lower random-shaped tiles 5, so the task of sequentially joining random-shaped files 5 upwards can proceed without problem.

Following joining the random-shaped tiles 5 to the entire wall area where the metal plate with holes 3 has been attached, a jointing material 8 is used to fill the gaps between the adjacent random-shaped tiles 5, as with the first embodiment.

Thus, according to the attachment structure for random-shaped wall facing material of the second embodiment, the weight of each random-shaped tile 5 is held by the attaching pieces 17 and 27 and wire 9, so that the force in the weight direction of the random-shaped tiles 5 is not applied to the elastic adhesive agent 6. Thus, this covers the weak point of the elastic adhesive agent 6 which is the shearing strength thereof, while obtaining the advantages of the elasticity of the elastic adhesive agent 6, i.e., absorbing and alleviating movement, shock, vibration, etc., of the backing, thereby preventing cracking and falling of the random-shaped tiles 5. Further, the random-shaped tiles 5 are also supported by the attaching pieces 17 and 27 and the wire 9, and thus falling is also prevented as a matter of course.

What is claimed is:

1. An attachment structure for random-shaped wall facing material, said attachment structure comprising:

a backing;

a retaining plate provided with a plurality of retaining portions over a surface of said retaining plate, said retaining plate being attached to a front plane of said backing;

a plurality of random-shaped wall facing material pieces arrayed on a front plane of said retaining plate in an arbitrary layout, said random-shaped wall facing material pieces being adhered to said retaining plate and said backing by an adhesive agent;

a plurality of attachment pieces being operable to support at least an upper edge portion and a lower edge portion of each of said random-shaped wall facing material pieces, said attachment pieces being retained by said retaining portions of said retaining plate; and a jointing material filling space in between adjacent ones of said random-shaped wall facing material pieces.

2. An attachment structure according to claim 1, wherein said retaining plate is one of:

a metal plate having a plurality of retaining holes serving as said retaining portions, the retaining holes opened over the surface of said metal plate in a uniform manner; and a net-shaped metal material having retaining mesh of an appropriate coarseness to serve as said retaining portions.

3. An attachment structure according to claim 1, wherein said retaining plate comprises a joining portion operable to join said retaining plate with said backing, said joining portion having a trapezoidal shape protruding from said retaining plate towards said backing and having a screw hole in a center thereof.

4. An attachment structure according to claim 2, wherein said retaining plate comprises a joining portion operable to join said retaining plate with said backing, said joining portion having a trapezoidal shape protruding from said retaining plate towards said backing and having a screw hole in a center thereof.

5. An attachment structure according to claim 1, wherein each of said attachment pieces comprises:

a supporting piece being operable to support an edge portion of one of said random-shaped wall facing material pieces placed on the front plane of said retaining plate, in a generally nipped state, by cooperating with a corresponding portion of said retaining plate; and a retaining piece continuing from said supporting piece, said retaining piece being retained by one of said retaining portions of said retaining plate.

6. An attachment structure according to claim 2, wherein each of said attachment pieces comprises:

a supporting piece being operable to support an edge portion of one of said random-shaped wall facing material pieces placed on the front plane of said retaining plate, in a generally nipped state, by cooperating with a corresponding portion of said retaining plate; and a retaining piece continuing from said supporting piece, said retaining piece being retained by one of said retaining portions of said retaining plate.

7. An attachment structure according to claim 3, wherein each of said attachment pieces comprises:

a supporting piece being operable to support an edge portion of one of said random-shaped wall facing material pieces placed on the front plane of said retaining plate, in a generally nipped state, by cooperating with a corresponding portion of said retaining plate; and a retaining piece continuing from said supporting piece, said retaining piece being retained by one of said retaining portions of said retaining plate.

8. An attachment structure according to claim 4, wherein each of said attachment pieces comprises:

a supporting piece being operable to support an edge portion of one of said random-shaped wall facing material pieces placed on the front plane of said retaining plate, in a generally nipped state, by cooperating with a corresponding portion of said retaining plate; and a retaining piece continuing from said supporting piece, said retaining piece being retained by one of said retaining portions of said retaining plate.

9. An attachment structure according to claim 1, wherein each of said attachment pieces is one of a first type of attachment piece and a second type of attachment piece, said first type of attachment piece comprising:

a receiving-plate-shaped supporting piece upon which is placed the lower edge portion of one of said random-shaped wall facing material pieces placed on the front plane of said retaining plate; and a retaining piece continuing from said receiving-plate-shaped supporting piece, said retaining piece being retained by said retaining portion of said retaining plate, and said second type of attachment piece comprising:

a supporting piece being operable to support the upper edge portion of one of said random-shaped wall facing material pieces placed on the front plane of said retaining plate, in a generally nipped state, by cooperating with a corresponding portion of said retaining plate; and a retaining piece continuing from said supporting piece, said retaining piece being retained by said retaining portion of said retaining plate.

10. An attachment structure according to claim 2, wherein each of said attachment pieces is one of a first type of attachment piece and a second type of attachment piece, said first type of attachment piece comprising:

a receiving-plate-shaped supporting piece upon which is placed the lower edge portion of one of said random-shaped wall facing material pieces placed on the front plane of said retaining plate; and a retaining piece continuing from said receiving-plate-shaped supporting piece, said retaining piece being retained by said retaining portion of said retaining plate, and said second type of attachment piece comprising:

a supporting piece being operable to support the upper edge portion of one of said random-shaped wall facing material pieces placed on the front plane of said retaining plate, in a generally nipped state, by cooperating with a corresponding portion of said retaining plate; and a retaining piece continuing from said supporting piece, said retaining piece being retained by said retaining portion of said retaining plate.

11. An attachment structure according to claim 3, wherein each of said attachment pieces is one of a first type of attachment piece and a second type of attachment piece, said first type of attachment piece comprising:

a receiving-plate-shaped supporting piece upon which is placed the lower edge portion of one of said random-shaped wall facing material pieces placed on the front plane of said retaining plate; and a retaining piece continuing from said receiving-plate-shaped supporting piece, said retaining piece being retained by said retaining portion of said retaining plate, and said second type of attachment piece comprising:

a supporting piece being operable to support the upper edge portion of one of said random-shaped wall facing material pieces placed on the front plane of said retaining plate, in a generally nipped state, by cooperating with a corresponding portion of said retaining plate; and a retaining piece continuing from said supporting piece, said retaining piece being retained by said retaining portion of said retaining plate.

12. An attachment structure according to claim 4, wherein each of said attachment pieces is one of a first type of attachment piece and a second type of attachment piece, said first type of attachment piece comprising:

a receiving-plate-shaped supporting piece upon which is placed the lower edge portion of one of said random-shaped wall facing material pieces placed on the front plane of said retaining plate; and a retaining piece continuing from said receiving-plate-shaped supporting piece, said retaining piece being retained by said retaining portion of said retaining plate, and said second type of attachment piece comprising:

a supporting piece being operable to support the upper edge portion of one of said random-shaped wall facing material pieces placed on the front plane of said retaining plate, in a generally nipped state, by cooperating with a corresponding portion of said retaining plate; and a retaining piece continuing from said supporting piece, said retaining piece being retained by said retaining portion of said retaining plate.

13. An attachment structure according to claim 1, further comprising a wire material, wherein one end of said wire material is fixed to a rear plane of each said random-shaped wall facing material pieces and another end of said wire material is joined to a pair of said retaining portions of said retaining plate.

14. An attachment structure according to claim 2, further comprising a wire material, wherein one end of said wire material is fixed to a rear plane of each said random-shaped wall facing material pieces and another end of said wire material is joined to a pair of said retaining portions of said retaining plate.

15. An attachment structure according to claim 3, further comprising a wire material, wherein one end of said wire material is fixed to a rear plane of each said random-shaped wall facing material pieces and another end of said wire material is joined to a pair of said retaining portions of said retaining plate.

16. An attachment structure according to claim 4, further comprising a wire material, wherein one end of said wire material is fixed to a rear plane of each said random-shaped wall facing material pieces and another end of said wire material is joined to a pair of said retaining portions of said retaining plate.

17. An attachment structure for random-shaped wall facing material, said attachment structure comprising:

a backing;

a retaining plate provided with a plurality of retaining portions over a surface of said retaining plate, said retaining plate being attachable to a front plane of said backing;

a plurality of random-shaped wall facing material pieces being operable to be arrayed on a front plane of said retaining plate in an arbitrary layout, said random-shaped wall facing material pieces being operable to be adhered to said retaining plate and said backing by an adhesive agent;

a plurality of attachment pieces being operable to support at least an upper edge portion and a lower edge portion of each of said random-shaped wall facing material pieces, said attachment pieces being operable to be retained by said retaining portions of said retaining plate, wherein space between adjacent random-shaped wall facing material pieces attached to said retaining plate is fillable with a jointing material.

* * * * *